US007850741B2

(12) United States Patent
Park et al.

(10) Patent No.: US 7,850,741 B2
(45) Date of Patent: Dec. 14, 2010

(54) CLEANSING POLYESTER FABRICS, AND A PROCESS OF PREPARING THE SAME

(75) Inventors: Yang-Soo Park, Gumi-si (KR); Heung-Ryul Oh, Seoul (KR); Dong-Eun Lee, Gumi-si (KR)

(73) Assignee: Kolon Industries, Inc., Kwacheon-Si (KR)

( * ) Notice: Subject to any disclaimer, the term of this patent is extended or adjusted under 35 U.S.C. 154(b) by 0 days.

(21) Appl. No.: 12/467,938

(22) Filed: May 18, 2009

(65) Prior Publication Data

US 2009/0223589 A1 Sep. 10, 2009

Related U.S. Application Data

(62) Division of application No. 10/583,895, filed as application No. PCT/KR2004/003389 on Dec. 22, 2004.

(30) Foreign Application Priority Data

Dec. 26, 2003 (KR) ..... 10-2003-0097275

(51) Int. Cl.
*D03D 15/04* (2006.01)

(52) U.S. Cl. ..... 8/114.6; 8/115.6; 8/636; 8/922; 28/156; 28/152; 57/243; 57/58.59; 57/332

(58) Field of Classification Search ..... 28/156, 28/152, 216; 57/243, 58, 59, 332, 58.59; 8/115.6, 114.6, 636, 922
See application file for complete search history.

(56) References Cited

U.S. PATENT DOCUMENTS

| | | | | |
|---|---|---|---|---|
| 4,000,342 | A * | 12/1976 | Rochelle et al. | 428/88 |
| 4,109,038 | A * | 8/1978 | Hayashi et al. | 428/91 |
| 5,657,521 | A * | 8/1997 | Gwon et al. | 28/168 |
| 5,935,883 | A | 8/1999 | Pike | |
| 6,632,504 | B1 | 10/2003 | Gillespie et al. | |

FOREIGN PATENT DOCUMENTS

| | | | |
|---|---|---|---|
| JP | 9-11067 | A | 5/1997 |
| JP | 10-088476 | A | 4/1998 |
| KR | 1994/011309 | B1 | 12/1994 |

* cited by examiner

*Primary Examiner*—Lorna M Douyon
*Assistant Examiner*—Amina Khan
(74) *Attorney, Agent, or Firm*—Birch, Stewart, Kolasch & Birch, LLP

(57) ABSTRACT

The present invention provides a cleansing polyester fabric, which comprises (i) a polyester multifilament consisting of ultra yarns (monofilament) of 0.001 to 0.1 deniers or its false twist yarn as warp and (ii) a false twisted mixing yarn consisting of said polyester multifilament and a high shrinkage polyester multifilament with 10-50% of shrinkage rate in boiling water as a weft, and said fabric satisfies the following properties; sum of warp density and weft density: 220-320 yarns/inch, thickness of the fabric: less than 0.3 mm, and weight of the fabric: 70-180 g/m$^2$. The cleansing fabric of the present invention is useful as a makeup cleansing fabric or as wiping fabric for fine products and optical devices since it exhibits excellent cleansing performance, is soft to the touch and does not damage the surface of products to be cleaned.

8 Claims, 5 Drawing Sheets

CLEANSING POLYESTER FABRICS, AND A PROCESS OF PREPARING THE SAME

This application is a Divisional of co-pending application Ser. No. 10/583,895 filed on Jun. 22, 2006 and for which priority is claimed under 35 U.S.C. §120. Application Ser. No. 10/583,895 is the national phase of PCT International Application No. PCT/KR2004/003389 filed on Dec. 22, 2004 under 35 U.S.C. §371, which claims priority to KR10-2003-0097275 filed on Dec. 26, 2003. The entire contents of each of the above-identified applications are hereby incorporated by reference.

TECHNICAL FIELD

The present invention relates to a cleansing polyester fabric and a process of preparing the same, and more particularly, to a cleansing fabric which is useful as a makeup cleansing cloth for removing cosmetics from the skin or as a wiping fabric for optical devices and optical storage media since it shows an excellent cleansing performance, is soft to the touch and is able to prevent surface damage of an object to be cleansed, and a process of preparing the same.

BACKGROUND ART

As the prior art for a cleansing fabric, Korean Patent Laid Open No. 1994-14987 proposes a process of preparing a cleaning polyester fabric by using a yarn made by interlacing a high shrinkage polyester yarn and a two-component polyester composite yarn as weft. However, the polyester fabric prepared by the above process has a problem that the cleansing performance and feel are deteriorated because the yarn fineness of a monofilament of warp and weft is larger than 0.3 deniers.

Meanwhile Japanese Patent Laid Open No. 2002-153406 proposes a makeup wiping fabric prepared by using a split type conjugated yarn having a triangle shape of cross-section after splitting and monofilament denier of 0.001~0.1 dtex as warp and weft.

However, the above mentioned wiping fabric is hard to the touch and damage the surface of a products to be cleansed because the fabric is prepared by using a split type conjugated yarn having a triangle shape of cross-section after splitting.

Accordingly, it is an object of the present invention to overcome the problems in the prior art and to provide a cleansing polyester fabric that is useful as a cleaning fabric for precision products, optical devices, etc. or a makeup cleansing fabric.

DISCLOSURE OF THE INVENTION

The present invention provides a cleansing polyester fabric which is useful as a makeup cleansing fabric or as a wiping fabric for precision products, optical devices, etc. since it shows an excellent cleansing performance, is soft to the touch and does not damage the surface of an object to be cleansed.

To achieve the above objects, there is provided a cleansing polyester fabric according to the present invention, which comprises (i) a polyester multifilament consisting of ultra yarns (monofilament fibrils) of 0.001 to 0.1 deniers or its false twist yarn as warp and (ii) a false twisted mixing yarn consisting the polyester multifilament consisting of ultra yarns (monofilament fibrils) of 0.001 to 0.1 deniers and a high shrinkage polyester multifilament with 10~50% of shrinkage rate in boiling water as weft, and the fabric satisfies the following properties;

Sum of warp density and weft density: 220~320 yarns/inch

Thickness of the fabric: less than 0.3 mm

Weight of the fabric: 70~180 g/m$^2$

Furthermore, there is provided a process of preparing a cleansing fabric according to the present invention, wherein a fabric with weight of 80~200 g m$^2$ is woven by using a sea-island type conjugated yarn with 0~10% of shrinkage rate in boiling water consisting of sea component and island component in which ultra fine yarns (monofilament fibrils) having a monofilament fineness of 0.001 to 0.1 deniers after extracting a sea component or its false twist yarn as warp and using a false twisted mixing yarn prepared by interlacing (folding and false twisting simultaneously) the sea-island type conjugated yarn and a high shrinkage polyester multifilament with 10~50% of shrinkage rate in boiling water as weft, the woven fabric being scoured and reduced simultaneously and then heat-set, the heat-set fabric being treated in an aqueous alkaline solution for extracting the sea component in the fabric with reduction rate of 28~38% (on the basis of the fabric weight) and dyed, the dyed fabric being heat-set again.

Hereinafter, the present invention will be described in detail.

The warp of the cleansing polyester fabric (hereinafter, abbreviated as the "fabric") of the present invention is polyester fiber multifilament consisting of ultra yarns (monofilament fibrils) of 0.001 to 0.1 denier or its false twist yarn.

The weft of the fabric of the present invention is a false twisted mixing yarn consisting the polyester multifilament consisting of ultra yarn (monofilament fibrils) of 0.001 to 0.1 denier and a high shrinkage polyester multifilament with 10~50% of shrinkage rate in boiling water.

The fabric of the present invention is prepared by weaving a fabric with weight of 80~200 g/m$^2$ by using a sea-island type conjugated yarn with 0~10% of shrinkage rate in boiling water consisting of sea component and island component in which ultra fine yarns (monofilament fibrils) having a monofilament fineness of 0.001 to 0.1 deniers after extracting a sea component or its false twist yarn as warp and using a false twisted mixing yarn prepared by interlacing (folding and false twisting simultaneously) the sea-island type conjugated yarn and a high shrinkage polyester multifilament with 10~50% of shrinkage rate in boiling water as weft, and then scouring, reducing, and heat-setting the woven fabric, and then extracting the sea component in the fabric with reduction rate of 28~38% (on the basis of the fabric weight) by treating the heat-set fabric in an aqueous alkaline solution.

Generally, a suede-like fabric is woven by using a sea-island type conjugated yarn with satin weave or raising the one face or faces of the woven fabric.

But, the fabric of the present invention is woven with plain weave or twill weave having short-repeat interval for example 2UP 1DOWN, 1UP 2DOWN, 2UP 2DOWN, 3UP 1DOWN or 1UP 3DOWN.

Also, the fabric of the present invention may be woven with plain weave of ground weave and figured weave of pattern forming weave.

It is more desirable to be woven with plain weave.

The fabric of the present invention have a sum of warp density and weft density of 220~320 yarns/inch.

More preferably, it is more desirable that the warp density becomes 150~210 yarns/inch and the weft density becomes 70~110 yarns/inch in the final fabric.

If the warp density and weft density are below this range, the shape stability of the fabric is deteriorated, which may bring about a problem that the fabric is worn out when used for a long time, or if the warp density and weft density are above this range, cost becomes higher and process becomes more difficult.

If the sea-island type conjugated yarn in which ultra fine yarns (monofilament fibrils) having monofilament fineness of 0.001 to 0.1 deniers after extracting a sea component is used as warp or weft alone, the ultra fine yarns (monofilament fibrils) can not be catched at weave point because space is formed at extracting point of the sea component.

The space is formed because the sea-island type conjugated yarn have high reduction rate of sea component of more than 30%.

Therefore, the above-mentioned sea-island typed conjugated yarn could not be used as warp or weft alone.

Accordingly, a suede-like fabric with thickness of 0.4~0.6 mm was woven by using a polyester yarn as warp and using a folding yarn consisting of a high shrinkage yarn and the sea-island type conjugated yarn as weft, or by using the folding yarn as warp and using the polyester yarn as weft with satin weave or two face satin weave, and then buffing or raising the one face or two faces of the woven fabric up to now.

The present invention is characterized that cleansing polyester fabric having a soft touch, excellent shape stability and thin thickness of less than 0.3 mm is manufactured by using a sea-island type conjugated yarn in which ultra fine yarns (monofilament fibrils) having monofilament fineness of 0.001 to 0.1 denier after extracting the sea component or its false twist yarn as warp alone.

Although the sea-island type conjugated yarn, which is not false-twisted after spinning and drawing can be used as the warp, it is more preferred to use as the warp a false twist yarn made by false-twisting the sea-island type conjugated yarn in order to prevent the warp and weft from slipping on the fabric and to enhance the cleansing performance.

The false twist yarn can be manufactured by processing the sea-island type conjugated yarn in a process as shown in FIG. 7.

Also, the present invention can prevent the warp and weft from slipping on the fabric and thus prevent the fabric from being worn out on account of using a false twisted mixing yarn prepared by folding and false twisting a sea-island type conjugated yarn and a high shrinkage yarn as weft simultaneously.

The false twisted mixing yarn can be manufactured by processing a sea-island type conjugate yarn and a high shrinkage yarn in a process as shown in FIG. 8.

Also, natural patterns of prominence and depression with very small shape are formed on the surface of the fabric uniformly by weaving the fabric with the above-mentioned warp density and weft density and dyeing the woven fabric according to condition of example.

The natural patterns of prominence and depression improve the appearance of fabric and cleansing effect when the fabric is used as cleansing clothes.

More preferably, the fabric of the present invention is surface-treated by a friction material to enhance its appearance and touch.

The aforementioned surface treatment can be conducted by rubbing the surface of the fabric with a roller or a disc or an apron comprised of woven fabric, knit fabric, non-woven fabric, leather, sandpaper, card clothing, ceramic material, metal, paper, wood, etc. attached thereto.

By the surface treatment using a friction material, the ultra fine yarns (monofilament fibrils) of the fabric of the invention receive an external force perpendicular to the warp as well as an external force parallel to the warp, thus the ultra fine yarns (monofilament fibrils) distributed in a biased manner as a set of warp and weft yarns within the fabric are dispersed/spread/reassembled to thus be uniformly distributed over the entire space of the fabric.

After dispersion, spreading and reassembling of a series of ultra fine yarns (monofilament fibrils), the space having no ultra fine yarns (monofilament fibrils) in the fabric before surface treatment is filled with ultra fine yarns (monofilament fibrils), and thus the average size of the space in the fabric is increased even further, making the fabric softer to the touch. Due to this, the feel is further improved and the space for collecting contaminants is also enlarged. Also, the ultra fine yarns (monofilament fibrils) are cross-linked with one another while they are dispersed/spread/reassembled, thereby having sufficient structural stability to withstand external forces applied to the fabric.

This fact becomes clearer by FIG. 1 and FIG. 3 and FIG. 10 which are electron micrograph showing surface or cross-section state after surface treatment.

The above-described cleansing fabric of this invention comprises ultra fine yarns (monofilament fibrils) of 0.001 to 0.1 denier as warp and weft, thus it is able to effectively collect fine contaminants by fine loop formed much by shrinking of a high shrinkage yarn and fine pores formed between the fine loop, has a soft feel and an excellent appearance, and does not damage the surface of an object to be cleansed.

Moreover, the cleansing fabric of this invention has an excellent appearance and structural stability and a soft touch since fine loops are formed on the front and/or surface thereof by surface treatment.

The island component of the sea-island type conjugated yarn is polyethyleneterephthalate and the sea component thereof is copolymer polyester having 1 to 10 mol % of dimethylene sulfoisophthalate sodium copolymerized therein.

Meanwhile, a weights of the woven fabric is 80~200 g/m$^2$.

If the weight of the woven fabric is less than 80 g/m$^2$, the shape stability of the fabric is deteriorated and warp and/or weft of the fabric is easily pushed to one side.

If the weight of the woven fabric is more than 200 g/m$^2$, thickness of the woven fabric with structure of the present invention becomes impossible.

In the present invention, the woven fabric is scoured and reduced at rotary scouring machine, and then preheated at 140° C.~170° C., and treated in an aqueous alkaline solution for extracting the sea component, and then after heated at 120° C.~140° C. in tenter type heat setting machine after dyeing.

A reduction rate of sea component, rate of the fabric weight after extracting the sea component with respect to the fabric weight before extracting the sea component, is 28~38 weight %.

If the reduction rate of sea component is less than 28 weight %, dyeing line is formed and touch is deteriorated because sea component is not extracted enough.

If the reduction rate of sea component is more than 38 weight %, the shape stability and durability of ultra fine yarns (monofilament fibrils) is deteriorated.

Next, the surface of the fabric is surface-treated by rubbing the same with a roller of FIG. 4 with a friction material attached thereto, a disc of FIG. 5 with a friction material attached thereto or an apron of FIG. 6 with a friction material attached thereto, thereby further improving the appearance and feel of the fabric.

The friction material may include woven fabric, knit fabric, non-woven fabric, leather, sandpaper, card clothing, ceramic material, metal, paper, wood, etc.

FIGS. 4 to 6 are, respectively, perspective views of a roller type surface treatment machine, disc type surface treatment machine and apron type surface treatment machine each used for surface treatment.

FIG. 1 is an electron micrograph showing the surface state of the fabric surface-treated according to the present invention. FIG. 2 and FIG. 3 are an electron micrograph showing the cross sectional state of the fabric surface-treated according to the present invention. FIG. 10 is an electron micrograph enlarging the a part of FIG. 1.

The cleansing fabric of the present invention prepared by the aforementioned process have thickness of less than 0.3 mm and weight of 70~180 g/m$^2$.

The cleansing fabric of the present invention prepared by the aforementioned process is very useful as a makeup cleansing fabric, a semiconductor product wiper, etc. since it shows an excellent cleansing performance, is soft to the touch and does not damage the surface of an object to be cleansed.

FIG. 9 is a schematic view showing an optical disc being surface-washed using the fabric of the present invention.

ADVANTAGEOUS EFFECTS

The present invention have an excellent cleansing performance and soft touch simultaneously and does not damage the surface of an object to be cleaned.

EXPLANATION OF REFERENCE NUMERALS FOR MAIN PARTS IN THE DRAWINGS

Figure 1:
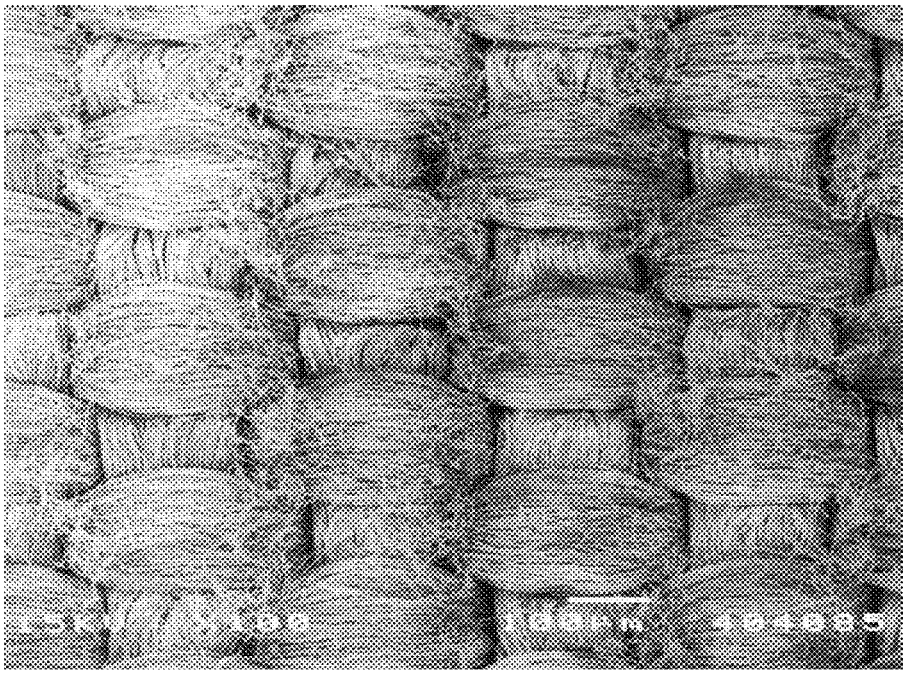
FIG. 1 is an electron micrograph showing the surface state of the fabric of the present invention right after a surface treatment process.
Figure 2:
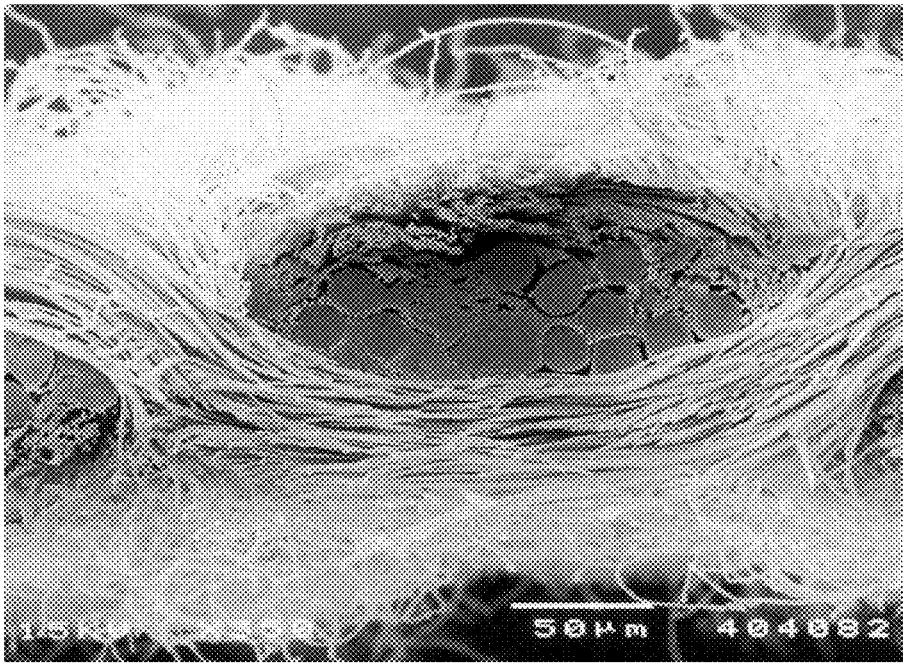
FIG. 2 is an electron micrograph showing the cross sectional state toward weft direction of the fabric of the present invention right after the surface treatment process.
Figure 3:
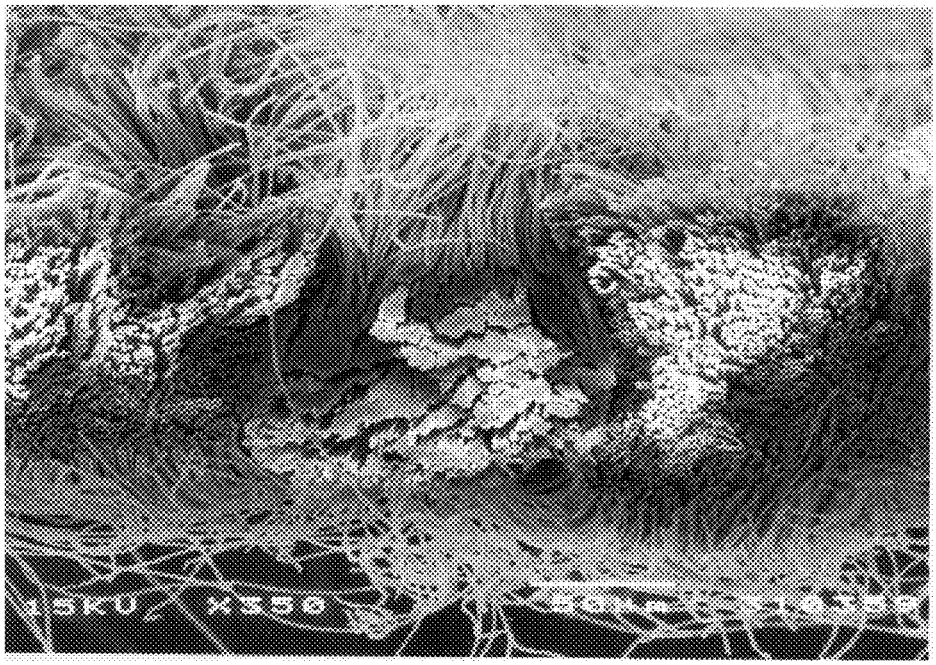
FIG. 3 is an electron micrograph showing the cross sectional state toward warp direction of the fabric of the present invention right after the surface treatment process.
Figure 4:
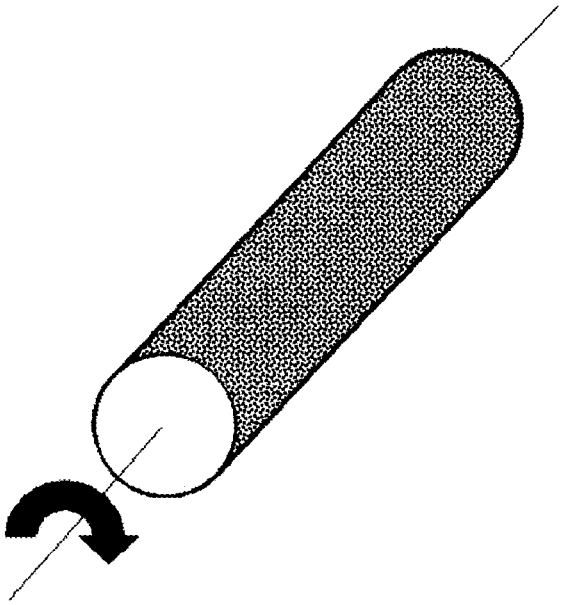
FIG. 4 is a perspective view of a roller type surface treatment machine used for surface treatment of the fabric of the present invention.
Figure 5:
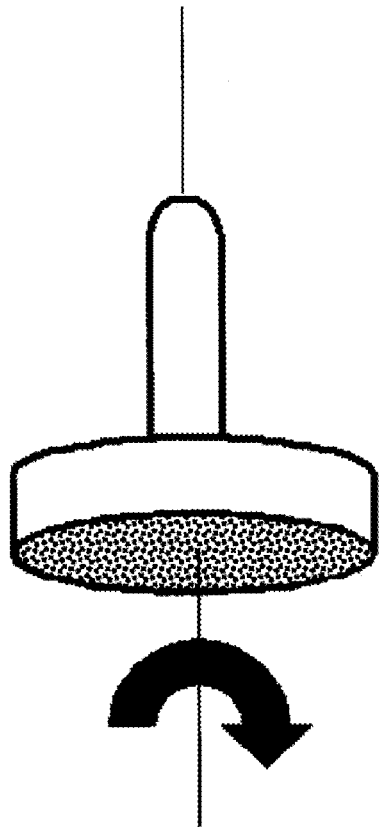
FIG. 5 is a perspective view of a disc type surface treatment machine used for surface treatment of the fabric of the present invention.
Figure 6:
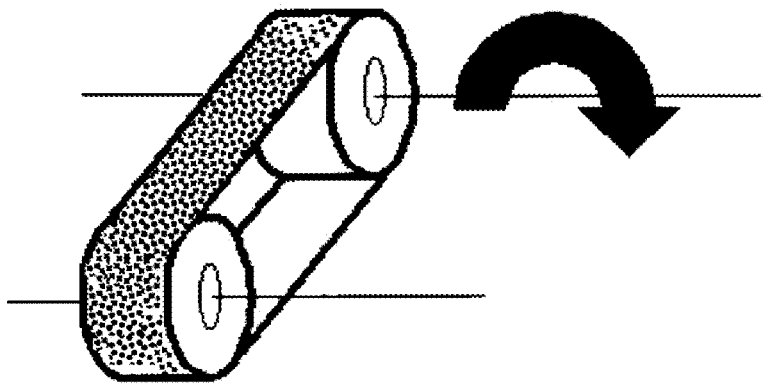
FIG. 6 is a perspective view of an apron type surface treatment machine used for surface treatment of the fabric of the present invention.
Figure 7:
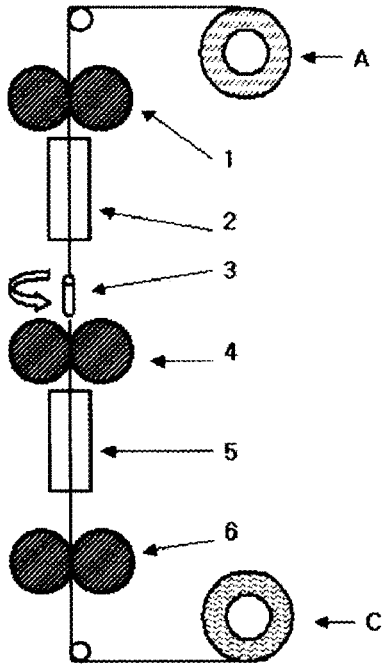
FIG. 7 is a schematic view of a process of preparing a false twist yarn according to the present invention.
Figure 8:
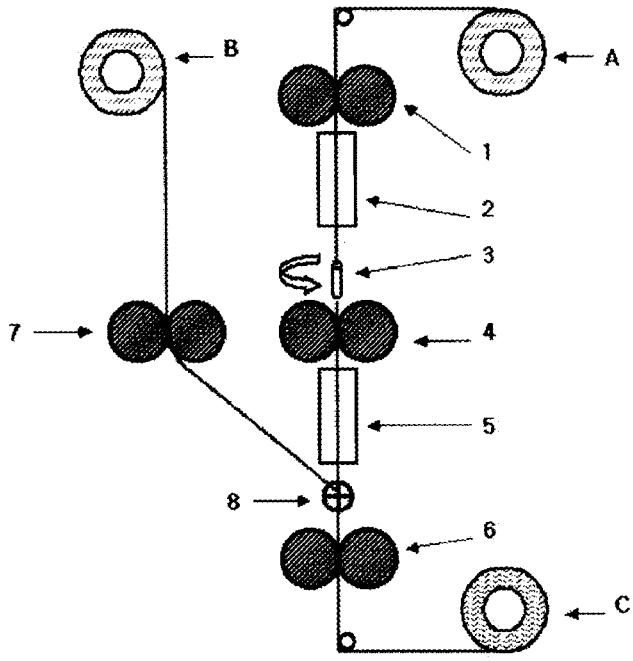
FIG. 8 is a schematic view of a process of preparing a false twisted mixing yarn according to the present invention.
Figure 9:
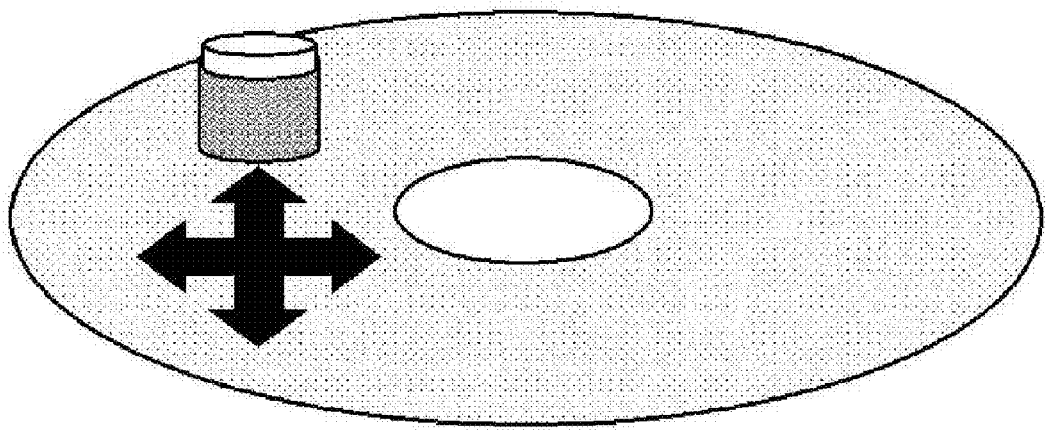
FIG. 9 is a schematic view showing an optical disc being surface-washed using the fabric of the present invention.
Figure 10:
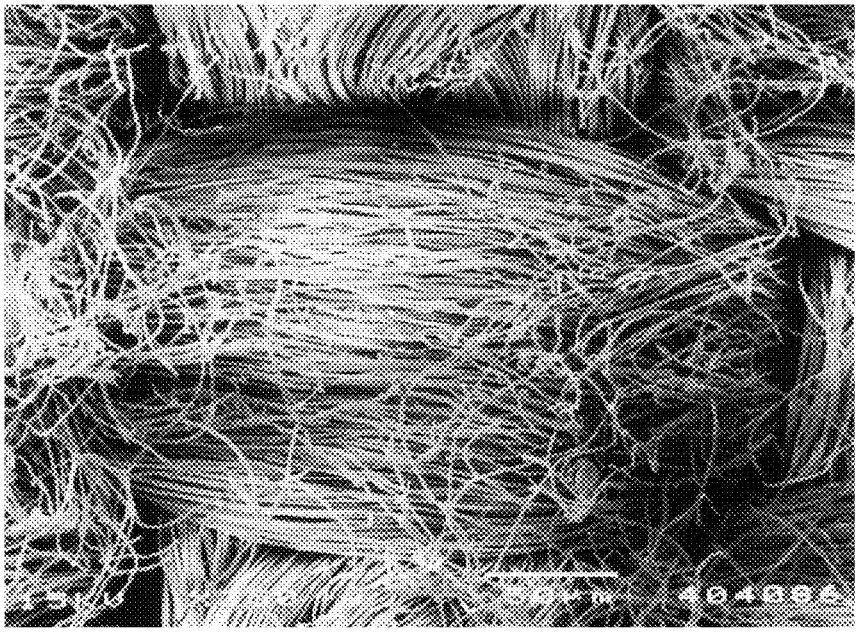
FIG. 10 is an electron micrograph enlarging a part of FIG. 1.

A: first yarn (sea-island type conjugated yarn)
B: second yarn (high shrinkage yarn)
C: take-up roller
1: first feed roller
2: first heater
3: twisting section (pin or disc)
4: second feed roller
5: thermosetting heater (second heater)
6: third feed roller
7: fourth feed roller
8: interlasing nozzle

BEST MODE FOR CARRYING OUT THE INVENTION

The present invention is now understood more concretely by way of examples of the present invention. However, the present invention is not limited to such examples.

EXAMPLE 1

A plain weave fabric with warp density of 160 yarn/inch, weft density of 80 yarn/inch and weight of 101 g/m$^2$ was prepared by using a polyester multifilament of 75 deniers/16 filaments with 3% of shrinkage rage in boiling water consisting of a sea-island type conjugated yarn comprising (i) polyethylene terephthalate as an island component and (ii) polyester copolymer as a sea component having 7 mol % of dimethylene sulfoisophthalate sodium copolymerized therein and thus being excellent in alkali hydrolyzabilty, the island component (monofilament fibrils) having a yarn fineness of 0.01 denier after extracting the sea component, as warp and using a false twisted mixing yarn of 105 deniers/28 filament, prepared by feeding the aforementioned sea-island type conjugated yarn as effect yarn and feeding polyester multifilament (high shrinkage yarn) of 30 deniers/12 filament with 18% of shrinkage rate in boiling water as core yarn, as weft.

Next, the woven fabric with weight of 12 kg was rolled in cylinder type, and then scoured and reduced at 120° C. and high pressure during 30 minutes in the rotary scouring machine.

Next, the scoured and reduced fabric was preheated at 160° C. in the tenter type heat setting machine.

Next, the preheated fabric was treated in the solution of 1% NaOH at 98° C. during 60 minutes in the liquid flowing type scouring and reducing machine for extracting the sea component.

At this time, the sea component was extracted at 34% by weight with respect to the total fabric weight.

Next, the fabric extracted the sea component was dyed at 130° C. during 30 minutes in air-flow dyeing machine of AFS-50 type made by THEN company.

At this time, control value of AFS-50 is set on Vx is equal to 45, RW is equal to 30, DA is equal to 15 and AT is equal to 10.

Next, the dyed fabric was postheated at 130° C. in the tenter type heat setting machine.

Next, the both surfaces of the fabric was surface-treated one time respectively by rubbing it with friction machine (SB-DB 3000 of SUNG BOK MACHINE COMPANT) attached six roller with a card clothing made of thermoplastic resin having hard inorganic particles distributed and dispersed therein, to thus obtain a cleansing polyester fabric having a thickness of 0.15 mm and weight of 86 g/m$^2$.

The results of evaluating the shape stability, cleaning performance (cleansing performance), appearance, feel when washing ones face and property of preventing a surface flaw when cleaning a compact disc are shown in Table 2.

EXAMPLES 2

A cleansing fabric was prepared under the same process and conditions as in Example 1 except that the types of warp and weft of the fabric, the thickness of the fabric and the weight of the fabric were changed as in Table 1.

The results of evaluating the shape stability, cleaning performance (cleansing performance), appearance, feel when washing ones face and property of preventing a surface flaw when cleaning a compact disc are shown in Table 2.

TABLE 1

| Preparation Conditions | | | | | |
|---|---|---|---|---|---|
| Classification | Type of warp | Type of weft | Wight of unprocessed fabric ($g/m^2$) | Wight of processed fabric ($g/m^2$) | Thickness of fabric (mm) |
| Example 1 | The aforementioned sea-island type conjugated yarn of 75 deniers/16 filaments (monofilament fineness of island component after extracting the sea component: 0.01 deniers) | The aforementioned false twisted mixing yarn of 105 deniers/28 filaments consisting of the aforementioned sea-island type conjugated yarn and the high shrinkage yarn | 101 | 86 | 0.19 |
| Example 2 | False twist yarn prepared by false twisting the sea-island type conjugated yarn of Example 1 (monofilament fineness of island component after extracting the sea component: 0.01 deniers) | The aforementioned false twisted mixing yarn of 105 deniers/28 filaments consisting of the aforementioned sea-island type conjugated yarn and the high shrinkage yarn | 101 | 91 | 0.21 |

TABLE 2

| Result of Physical Properties | | | | | |
|---|---|---|---|---|---|
| Classificaion | Shape stability | Cleansing performance | Face-Washing Feel | Property of preventing surface flaw when cleaning compact disc | Appearance |
| Example 1 | excellent | excellent | good | excellent | excellent |
| Example 2 | excellent | excellent | excellent | excellent | excellent |

In Table 2, the structural stability, feel when washing ones face and appearance were observed with the eye and tested by five panelists:

Excellent: Four or more panelists found that the fabric was excellent

Good: Three panelists found that the fabric was excellent

Average: Two panelists found that the fabric was excellent

Poor: One or no panelists found that the fabric was excellent

The cleansing performance was evaluated as follows. After opening a blank CD-ROM disc, a spray type lubricating agent was sprayed thereon for one second from a distance of 1 m, then baby powder was scattered evenly thereon from a distance of 0.1 m and then blown out by spraying compressed air, then a cotton cloth having a thickness of 1 mm was covered on a 250 g cylindrical weight and then wrapped in the fabrics of Examples 1 to 5, the upper sides were tied with a rubber band, and the surface of the disc was wiped 10 times from the center to the outer periphery using the fabrics. Afterwards, the performance of cleansing the surface of the disc was observed with the eye and tested by five panelists:

Excellent: Four or more panelists found that the fabric was excellent

Good: Three panelists found that the fabric was excellent

Average: Two panelists found that the fabric was excellent

Poor: One or less panelist found that the fabric was excellent

The property of preventing a surface flaw when cleaning a compact disc was evaluated as follows. After opening a blank CD-ROM, a cotton cloth having a 1 mm thickness was covered on a 250 g cylindrical weight and then wrapped in the fabrics of Examples 1 to 5, the upper sides were tied with a rubber band, and then the surface of the disc was wiped 10 times from the center to the outer periphery using the fabrics. Afterwards, the property of preventing a flaw on the surface of the disc was observed with the eye and tested by five panelists:

Excellent: Four or more panelists found that the fabric was excellent

Good: Three panelists found that the fabric was excellent

Average: Two panelists found that the fabric was excellent

Poor: One or less panelist found that the fabric was excellent

INDUSTRIAL APPLICABILITY

The present invention shows an excellent cleansing performance, is soft to the touch and does not damage the surface of an object to be cleansed.

Due to this, the present invention is especially useful as a makeup cleansing fabric or as a wiping fabric for precision products, optical devices, etc.

What is claimed is:

1. A process of preparing a cleansing polyester fabric, comprising the steps of:

(a) weaving a warp and a weft to obtain a woven fabric, (b) scouring and reducing the woven fabric at the same time;

(c) heat-setting the woven fabric obtained from step (b);

(d) extracting sea components from the heat-set woven fabric (c) in an aqueous alkaline solution with reduction rate of 28-38% on a basis of the fabric weight;

(e) dying the fabric obtained from step (d); and (f) heat-setting the dyed fabric to obtain the cleansing polyester fabric having a weight of 80-200 g/m$^2$, wherein the warp is composed of a sea-island conjugated yarn having 0-10% shrinkage rate in boiling water or its false twisted yarn, the sea-island conjugated yarn consists of a sea component and an island component, and ultra fine yarns (monofilament fibrils) having a monofilament fineness of 0.001 to 0.1 deniers after extracting the sea component, and wherein the weft is composed of a false twisted mixing yarn prepared by interlacing (folding and false twisting simultaneously) a sea-island conjugated yarn having 0-10% shrinkage rate in boiling water and a polyester multifilament having 10-50% of shrinkage rate in boiling water, the sea-island conjugated yarn consists of a sea component and an island component, and ultra fine yarns (monofilament fibrils) having a monofilament fineness of 0.001 to 0.1 deniers after extracting the sea component.

2. The process of claim 1, wherein the warp and weft are woven into a plain weave or twill weave.

3. The process of claim 1, wherein the fabric consists of (I) a ground weave, and (II) a pattern forming weave of a figured weave.

4. The process of claim 1, wherein the surface of the fabric is surface-treated by rubbing the same with a roller, a disc or an apron with a friction material attached thereto.

5. The process of claim 1, wherein the fabric is preheated and post-heated at 120 to 170° C. before and after dyeing.

6. The process of claim 1, wherein weight of the heat-set fabric is 70-180 g/m$^2$.

7. The process of claim 3, wherein the ground weave is a plain weave or twill weave.

8. The process of claim 1, wherein a thickness of the cleansing polyester fabric is less than 0.3 mm.

* * * * *